US011612025B2

(12) United States Patent
Liao et al.

(10) Patent No.: US 11,612,025 B2
(45) Date of Patent: Mar. 21, 2023

(54) ILLUMINATION POWER CIRCUIT WITH DIMMING FUNCTION AND ASSOCIATED CONTROL METHOD

(71) Applicant: FSP TECHNOLOGY INC., Taoyuan (TW)

(72) Inventors: Chou-Pao Liao, Taoyuan (TW); Chao-An Chen, Taoyuan (TW)

(73) Assignee: FSP TECHNOLOGY INC., Taoyuan (TW)

( * ) Notice: Subject to any disclaimer, the term of this patent is extended or adjusted under 35 U.S.C. 154(b) by 0 days.

(21) Appl. No.: 17/359,668

(22) Filed: Jun. 28, 2021

(65) Prior Publication Data

US 2022/0046771 A1 Feb. 10, 2022

(30) Foreign Application Priority Data

Aug. 7, 2020 (TW) ..... 109126792

(51) Int. Cl.

| | |
|---|---|
| ***H05B 45/10*** | (2020.01) |
| ***H05B 45/325*** | (2020.01) |
| ***H05B 45/3725*** | (2020.01) |
| ***H05B 47/25*** | (2020.01) |
| ***H05B 45/355*** | (2020.01) |

(52) U.S. Cl.

CPC ..... *H05B 45/10* (2020.01); *H05B 45/325* (2020.01); *H05B 45/355* (2020.01); *H05B 45/3725* (2020.01); *H05B 47/25* (2020.01)

(58) Field of Classification Search

CPC ..... H05B 45/10; H05B 45/37; H05B 45/355; H05B 45/325; H05B 45/3725; H05B 47/25

See application file for complete search history.

(56) References Cited

U.S. PATENT DOCUMENTS

| | | | | |
|---|---|---|---|---|
| 9,113,513 | B1 * | 8/2015 | Jungwirth | H05B 45/46 |
| 2014/0055044 | A1 * | 2/2014 | Kraft | H05B 45/46 315/185 R |
| 2018/0220506 | A1 * | 8/2018 | Sadwick | H05B 47/18 |

(Continued)

FOREIGN PATENT DOCUMENTS

| | | | | |
|---|---|---|---|---|
| CN | 101801143 A * | 8/2010 | | H05B 39/02 |
| WO | WO-2016085738 A1 * | 6/2016 | | G01R 31/3277 |

*Primary Examiner* — Abdullah A Riyami
*Assistant Examiner* — Syed M Kaiser
(74) *Attorney, Agent, or Firm* — Winston Hsu

(57) ABSTRACT

An illumination power circuit with a dimming function and an associated control method thereof are provided, where the illumination power circuit includes a first conversion circuit, a digital controller and a second conversion circuit. The first conversion circuit converts a first analog dimming signal from an analog dimmer into a first digital dimming signal, where the analog dimmer generates the first analog dimming signal according to operations of a user, to allow the user to manually control brightness of an illumination device. The digital controller receives the first digital dimming signal and a control signal from a computer, and generates at least one final dimming signal according to the first digital dimming signal and the control signal. In addition, the second conversion circuit generates a direct current output signal according to the final dimming signal, for driving the illumination device.

11 Claims, 5 Drawing Sheets

(56) References Cited

U.S. PATENT DOCUMENTS

| | | | | |
|---|---|---|---|---|
| 2019/0098725 | A1* | 3/2019 | Sadwick | F21S 2/00 |
| 2019/0320515 | A1* | 10/2019 | Sadwick | H05B 45/00 |
| 2019/0335552 | A1* | 10/2019 | Iqbal | H05B 45/10 |
| 2020/0413510 | A1* | 12/2020 | Krattiger | H05B 47/19 |

* cited by examiner

ILLUMINATION POWER CIRCUIT WITH DIMMING FUNCTION AND ASSOCIATED CONTROL METHOD

BACKGROUND OF THE INVENTION

1. Field of the Invention

The present invention is related to illumination power circuits, and more particularly, to an illumination power circuit with a dimming function and a control method thereof.

2. Description of the Prior Art

Conventional light-emitting diode (LED) illumination is controlled by a direct current (DC) voltage output from an analog dimmer. For example, brightness of an LED illumination device is determined by inputting a certain voltage level from 1 V to 10 V. If the LED illumination device is desired to be made waterproof, the manufacturer may perform glue-filling upon an outer case of an LED power circuit, which means that operation parameters of the LED power circuit cannot be amended after the glue-filling is completed. When concerns of end-of-life (EOL) or light decay occurs to the LED, the manufacturer may need to modify a driving current output to the LED illumination device (e.g. at the beginning of the product's life cycle, only 80% current will be output). As a DC input voltage is unable to effectively transfer a signal carrying specific information, the manufacturer is unable to perform further parameter settings on the control mechanism of the LED illumination through the terminal which is arranged to receive the DC input voltage. An analog dimming method taught in the related art can modify a color temperature and/or brightness of the LED, but this dimming method suffers from low dimming precision and is unable to perform intelligent control.

SUMMARY OF THE INVENTION

An objective of the present invention is to provide an illumination power circuit with a dimming function and a control method thereof, to improve flexibility of a light-emitting diode (LED) illumination device on implementing design functions.

Another objective of the present invention is to provide an illumination power circuit with a dimming function, and a control method thereof, which can solve the problem of the related art without introducing any side effect or in a way that is less likely to introduce side effects.

At least one embodiment of the present invention provides an illumination power circuit with a dimming function, wherein the illumination power circuit may comprise a first conversion circuit, a digital controller coupled to the first conversion circuit, and a second conversion circuit coupled to the digital converter. The first conversion circuit may be configured to convert a first analog dimming signal from an analog dimmer into a first digital dimming signal, wherein the analog dimmer is configured to generate the first analog dimming signal according to operations of a user, to allow the user to manually control brightness of an illumination device. The digital controller may be configured to receive the first digital dimming signal and a control signal from a computer, and generate at least one final dimming signal according to the first digital dimming signal and the control signal. In addition, the second conversion circuit may be configured to generate a direct current (DC) output signal according to the at least one final dimming signal, for driving the illumination device.

At least one embodiment of the present invention provides a control method of an illumination power circuit, wherein the illumination power circuit is equipped with a dimming function. The control method may comprise: utilizing a digital controller to receive a control signal from a computer; utilizing a first conversion circuit to convert a first analog dimming signal from an analog dimmer into a first digital dimming signal, wherein the analog dimmer is configured to generate the first analog dimming signal according to operations of a user, to allow the user to manually control brightness of an illumination device; utilizing the digital controller to receive the first digital dimming signal from the first conversion circuit; utilizing the digital controller to generate at least one final dimming signal according to the first digital dimming signal and the control signal; and utilizing a second conversion circuit to generate a direct current (DC) output signal according to the at least one final dimming signal, for driving the illumination device.

The illumination power circuit and the control method thereof provided by the embodiments of the present invention can convert an analog dimming signal output from an analog dimmer into a digital dimming signal, which is able to be recognized by a digital controller. Thus, the digital controller can receive related commands from a computer, and process the digital dimming signal according to these commands to implement associated functions.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
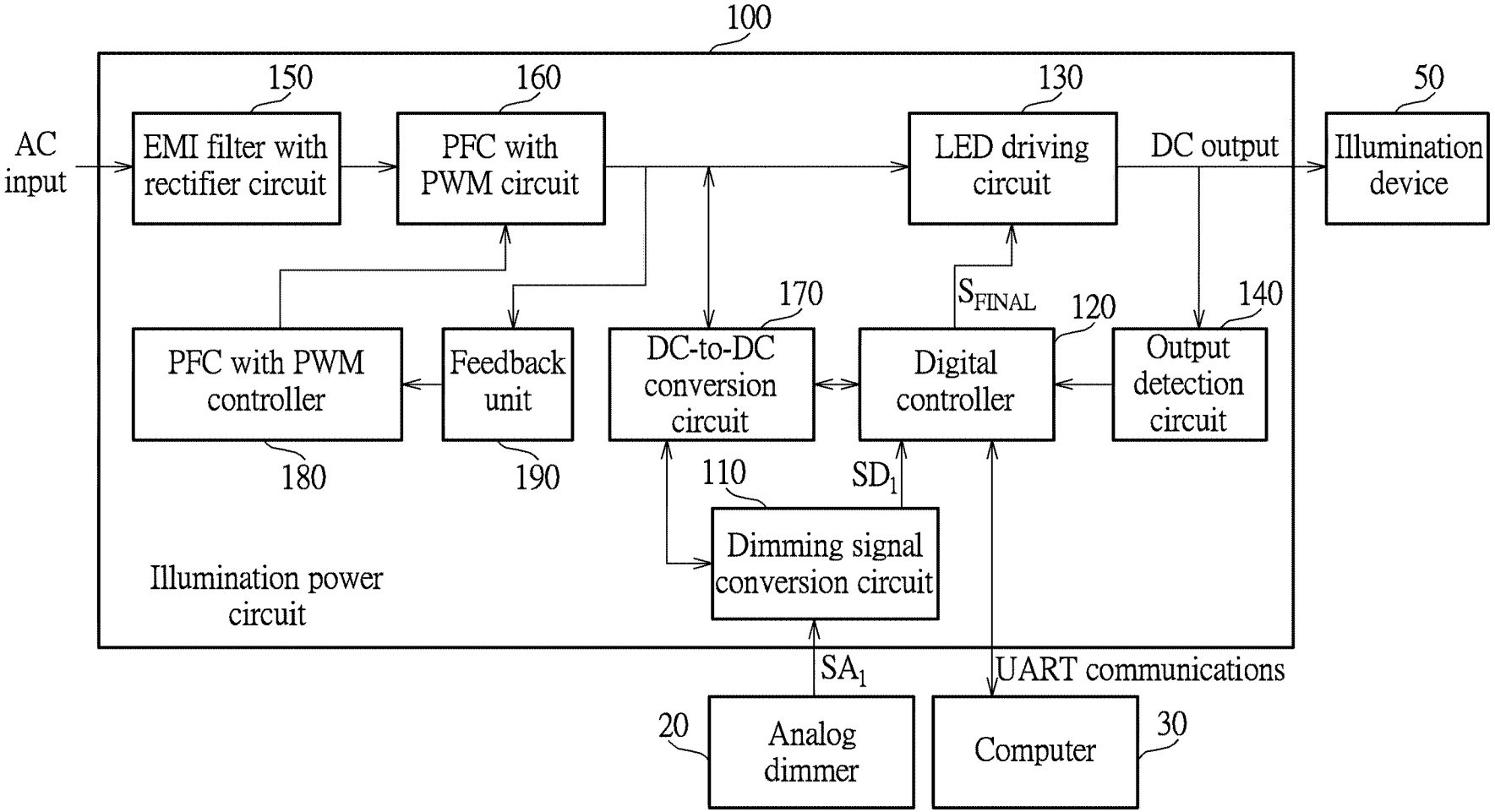
FIG. 1 is a diagram illustrating an illumination power circuit according to an embodiment of the present invention.

FIG. 1 is a diagram illustrating an illumination power circuit 100 according to an embodiment of the present invention, where the illumination power circuit 100 is equipped with a dimming function, and the illumination power circuit 100 conforms to Digital Addressable Lighting Interface (DALI) specifications. In this embodiment, the illumination power circuit 100 may be coupled to an illumination device 50, e.g. a light-emitting diode (LED) illumination device, and may be further coupled to an analog dimmer 20 or a computer 30 (e.g. a host device). It should be noted that FIG. 1 shows both the analog dimmer 20 and the computer 30 for better comprehension. In practice, the illumination power circuit 100 is not limited to be coupled to the analog dimmer 20 and the computer 30 at a same time. For example, the illumination power circuit 100 may be connected with one of the analog dimmer 20 and the computer 30 through sharing a connecting port. More particularly, when the illumination power circuit 100 is connected with the analog dimmer 20 through the connecting port, the illumination power circuit 100 operates in a dimming mode; and when the illumination power circuit 100 is connected with the computer 30 through the connecting port, the illumination power circuit 100 operates in a setting mode.

As shown in FIG. 1, the illumination power circuit 100 may comprise a first conversion circuit such as a dimming signal conversion circuit 110, a digital controller 120 (e.g. a micro controller unit, which may be referred to as an MCU for brevity) coupled to the dimming signal conversion circuit 110, and a second conversion circuit coupled to the digital controller 120, where the second conversion circuit may be a direct current (DC) to direct current (DC-to-DC) conversion circuit such as an LED driving circuit 130. The dimming signal conversion circuit 110 may be configured to convert a first analog dimming signal $SA_1$ from the analog dimmer 20 into a first digital dimming signal $SD_1$ such as a pulse-width modulation (PWM) signal, where the analog dimmer 20 is configured to generate the first analog dimming signal $SA_1$ according to operations of a user (e.g. controlling a voltage level of the analog dimming signal $SA_1$ to be a certain voltage level within a predetermined voltage range, such as a range from 1 V to 10 V via a knob installed on the analog dimmer), to allow the user to manually control brightness of the illumination device 50. The digital controller 20 may be configured to receive the first digital dimming signal $SD_1$ and a control signal from the computer 30. For example, the computer 30 may perform communication with the illumination power circuit 100 through a Universal Asynchronous Receiver/Transmitter (UART). The digital controller 120 may further generate at least one final dimming signal such as a dimming signal $S_{FINAL}$ according to the first digital dimming signal $SD_1$ and the control signal. In addition, the LED driving circuit 130 may be configured to generate a DC output signal such as a DC output current (labeled "DC output" in FIG. 1 for brevity) according to the dimming signal $S_{FINAL}$. For example, the dimming signal conversion circuit 110 may receive an analog dimming signal (e.g. the first analog dimming signal $SA_1$) output from the analog dimmer 20, and convert this analog dimming signal into a digital signal such as the first digital dimming signal $SD_1$ to the digital controller 120. The digital controller 120 then executes a program to parse this digital signal, and outputs a PWM dimming signal (e.g. the final dimming signal $S_{FINAL}$) after performing dimming calculation and command conversion, to control the DC-to-DC conversion circuit such as the LED driving circuit 130 to achieve the objective of modifying the brightness of the illumination device 50. In addition, the illumination power circuit 100 may further comprise an output detection circuit 140, where the output detection circuit 140 may detect the DC output signal and accordingly generate a detection result for the digital controller 120 to provide a feedback control on the output voltage/current according to the detection result, thereby stabilizing the voltage/current, but the present invention is not limited thereto.

As shown in FIG. 1, the illumination power circuit 100 may further comprise a rectifier circuit such as an Electromagnetic Interference (EMI) filter with rectifier circuit 150, a power factor correction (PFC) with PWM circuit 160, and a third conversion circuit such as a DC-to-DC conversion circuit 170. In this embodiment, the EMI filter with rectifier circuit 150 is configured to receive an alternating current (AC) input voltage (labeled "AC input" in FIG. 1 for brevity) and convert the AC input voltage into a first DC voltage. An end of the PFC with PWM circuit 160 may be coupled to the EMI filter with rectifier circuit 150, and the PFC with PWM circuit 160 may be configured to perform power factor correction and PWM upon the first DC voltage to generate a second DC voltage in order to output the second DC voltage, which is corrected and modulated, to the DC-to-DC conversion circuit 170 and the LED driving circuit 130. Furthermore, an end of the DC-to-DC conversion circuit 170 may be coupled to the PFC with PWM circuit 160, and another end of the DC-to-DC conversion circuit 170 may be coupled to the digital controller 120, where the DC-to-DC conversion circuit 170 may convert the second DC voltage into a third DC voltage and output the third DC voltage to the digital controller 120. In addition, the illumination power circuit 100 may further comprise a PFC with PWM controller 180, where the PFC with PWM controller 180 may generate a feedback path with the aid of a feedback unit 190, for controlling operations of the PFC with PWM circuit 160 to thereby generate the second DC voltage which is corrected, but the present invention is not limited thereto.

In this embodiment, the dimming signal $S_{FINAL}$ is a second analog dimming signal (a voltage signal within a voltage range from 0 V to 3.3 V) or a second digital dimming signal (e.g. a PWM signal having a corresponding duty cycle). In particular, when the user controls the brightness of the illumination device 50 to be lower than a predetermined brightness (e.g. lower than 7% brightness), the digital controller 120 may transmit the second digital dimming signal to the LED driving circuit 130, to allow the LED driving circuit 130 to generate the DC output signal (e.g. the second digital dimming signal is a PWM signal, and the LED driving circuit 130 may generate a corresponding output current according to a duty cycle of this PWM signal) according to the second digital dimming signal; and when the user controls the brightness of the illumination device 50 to be higher than the predetermined brightness (e.g. higher than 7% brightness), the digital controller 120 may transmit the second analog dimming signal to the LED driving circuit 130, to allow the LED driving circuit 130 to generate the DC output signal according to the second analog dimming signal. When the user controls the illumination device 50 to have 7% brightness, a voltage level of the second analog dimming signal corresponding to this brightness is relatively low. This voltage level is more likely to be interfered with by noise or is hard to be correctly identified by the LED driving circuit 140 due to external factors; the generated DC output signal is therefore affected. By comparison, the second digital dimming signal utilizes different PWM duty cycles to correspond to difference brightness levels, and is therefore less likely to be affected by noise. When the user controls the illumination device 50 to have 20% brightness, a voltage level of the second analog dimming signal corresponding to this brightness is relatively high; this voltage level is less likely to result in the LED driving circuit 130 being unable to identify the correct voltage level due to noise. Thus, the digital controller 120 can transmit the second analog dimming signal (rather than the second digital dimming signal) to the LED driving circuit 140, which can prevent the problems of DC output abnormality caused by interference between the second digital dimming signal and frequency of the DC-to-DC conversion circuit 170.

Figure 2:
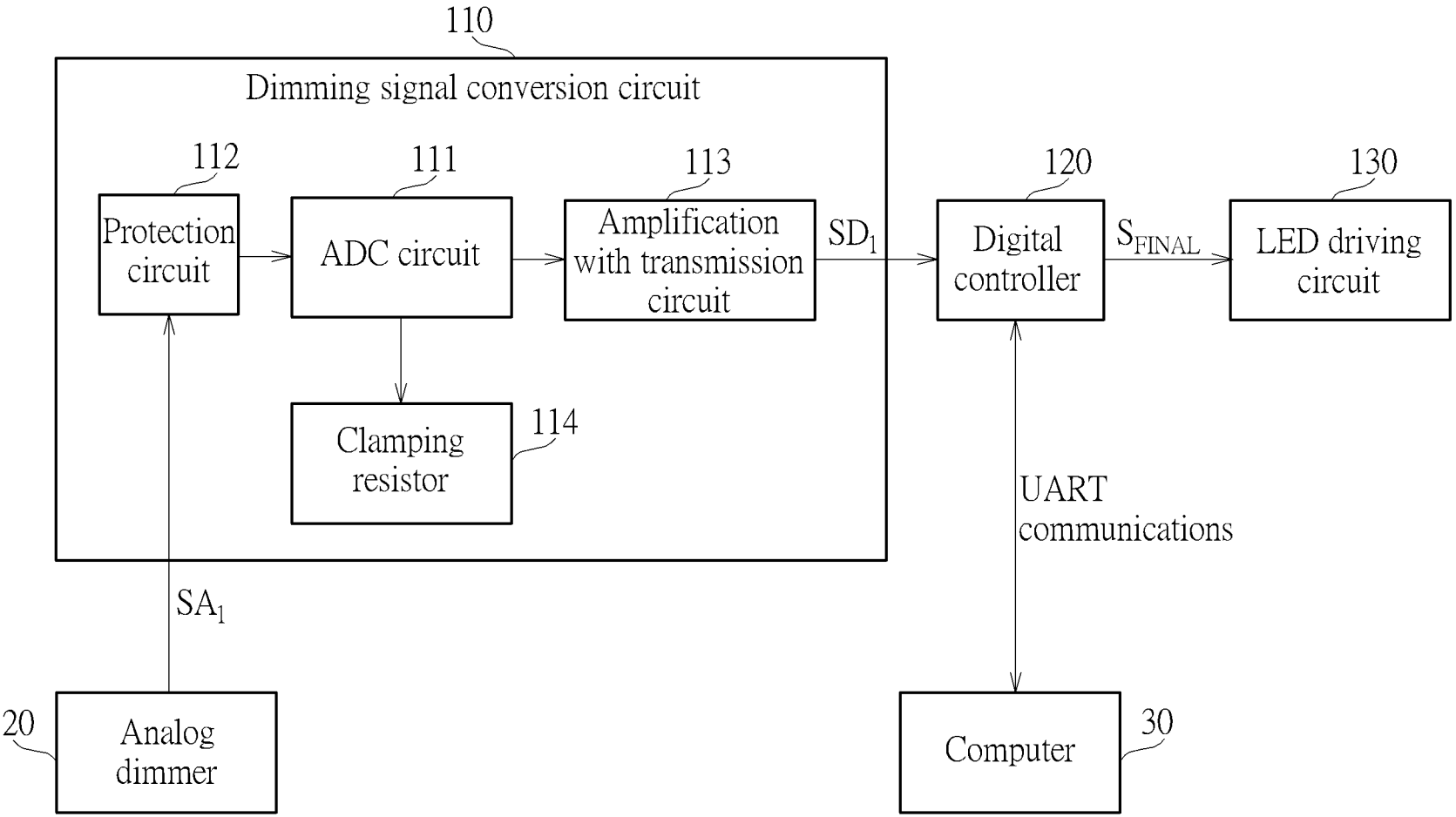
FIG. 2 is a diagram illustrating implementation details of a dimming signal conversion circuit within the illumination power circuit shown in FIG. 1 according to an embodiment of the present invention.

FIG. 2 is a diagram illustrating some implementation details of the dimming signal conversion circuit 110 according to an embodiment of the present invention, where the dimming signal conversion circuit 110 may comprise an analog-to-digital conversion (ADC) circuit 111, a protection circuit 112 and an amplifier circuit such as an amplification with transmission circuit 113. In this embodiment, the ADC circuit 111 may be configured to convert the first analog dimming signal $SA_1$ into a digital dimming signal. For example, the first analog dimming signal $SA_1$ is output from the analog dimmer 20 and is transmitted to the ADC circuit 111 through the protection circuit 112 for being converted.

The protection circuit 112 may be coupled to an end of the ADC circuit 111 in order to protect the ADC circuit 111, where the protection circuit 112 may limit a current flowing to the ADC circuit 111. In addition, the amplification with transmission circuit 113 may be coupled to another end of the ADC circuit 111 (e.g. an output terminal thereof), where the amplification with transmission circuit 113 may be configured to amplify the digital dimming signal output from the ADC circuit 111 to generate a first digital dimming signal $SD_1$. It should be noted that the dimming signal conversion circuit 110 further comprises a switch component or an optical coupler for transmitting the first digital dimming signal to the digital controller 120 through isolated transmission. For example, ground terminals of the dimming signal conversion circuit 110 (and the analog dimmer 20) are separated from those of the digital controller 120, and there is no common connected or shared ground voltage. Thus, the risk of electric shock due to being accidently touched by a user can be effectively prevented. In addition, the dimming signal conversion circuit 110 may further comprise a clamping resistor 114 configured to limit a voltage level of any node within the ADC circuit 111, but the present invention is not limited thereto.

Figure 3:
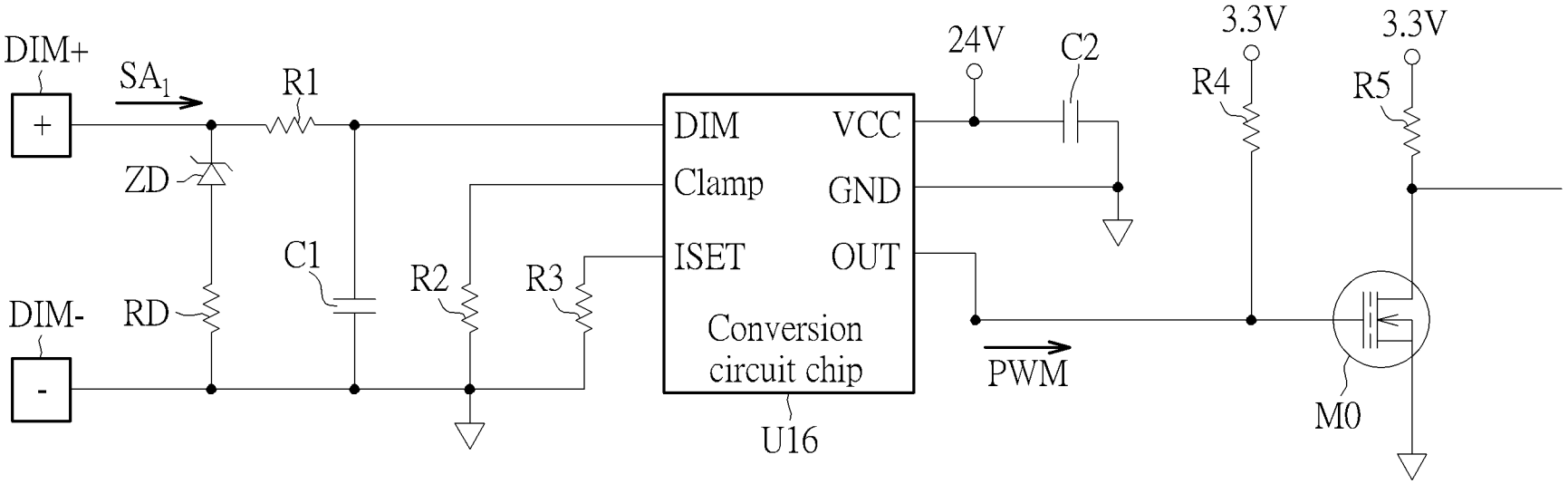
FIG. 3 is an example of the dimming signal conversion circuit shown in FIG. 2.

FIG. 3 is an example of the dimming signal conversion circuit 110 shown in FIG. 2, where the ADC circuit 111 may be implemented by a conversion circuit chip U16 (e.g. analog-to-digital chips or analog-to-PWM chips which are common on the market). In this embodiment, the protection circuit 112 shown in FIG. 2 may be implemented by a diode ZD (e.g. a Zener diode) and a resistor RD, to thereby protect the conversion circuit chip U16 from being damaged by an instantaneous large current/voltage. Furthermore, a resistor R1 and a capacitor C1 may play the role of a filter, in order to filter out glitch or noise on voltages input from terminals DIM+ and DIM−. The filtered voltage may be sent to a pin DIM of the conversion circuit chip U16, where the user may specify functions equipped on the conversion circuit chip U16 on their own, or utilize digital dimming signals specified by DALI. The clamping resistor 114 may be implemented by a resistor R2 coupled to a pin Clamp of the conversion circuit chip U16, and a resistor R3 may be coupled to a pin ISET of the conversion circuit chip U16 in response to requirements of modifying an output frequency (e.g. switching frequency of the PWM signal such as 1.5 kHz) of the conversion circuit chip U16. In addition, the conversion circuit chip U16 may receive power (e.g. 24 V power supply voltage) via a pin VCC and utilize a capacitor C2 coupled between the pins VCC and GND for voltage stabilization. A resistor R4 may be coupled between a 3.3 V voltage terminal and a pin OUT of the conversion circuit chip U16, to bias the output signal at a determined voltage. At least one amplifier within the amplification with transmission circuit 113 may be implemented by a resistor R5 and an active device (e.g. transistor) MO. For example, when the first analog dimming signal $SA_1$ (e.g. a voltage signal within a voltage range from 1 V to 10 V) output from the analog dimmer 20 is input to the pin DIM of the conversion circuit chip U16 from the terminals DIM+ and DIM− via the resistor R1, the first analog dimming signal $SA_1$ may pass through an integrating loop and an analog-to-digital converter, to output a PWM output signal PWM over 700 Hz on the pin OUT. The PWM output signal PWM may be configured to transmit the first digital dimming signal $SD_1$ to the digital controller 120 via the active device MO for interpretation and decoding, where the PWM output signal PWM may be transmitted via an optical coupler for the purpose of isolated dimming (e.g. by signal isolation or isolated transmission, preventing a user from getting an electric shock due to touching the analog dimmer).

As the first analog dimming signal $SA_1$ generated by the analog dimmer 20 cannot be directly transmitted via the aforementioned switch component or the optical coupler for isolated transmission, the dimming signal conversion circuit 110 provided by the embodiment of the present invention can convert the first analog dimming signal $SA_1$ into the first digital dimming signal $SD_1$ (which is able to be transmitted via the aforementioned switch component and the optical coupler), in order to achieve the effect of isolated transmission. Furthermore, as the first digital dimming signal $SD_1$ can be recognized by the digital controller 120, and the digital controller 120 can be connected with external devices such as the computer 30 via UART communications, when operations of a whole illumination system needs to be updated, the manufacturer may connect the computer 30 to the illumination power circuit 100 (more particularly, to the digital controller 120 therein), in order to utilize the computer 30 to update or modify a program file within the digital controller 120. Taking a condition where the illumination power circuit 100 is connected with one of the analog dimmer 20 and the computer 30 by sharing a connecting port, when the illumination power circuit 100 is connected with the analog dimmer 20 via the connecting port, the illumination power circuit 100 operates in the dimming mode, the dimming signal conversion circuit 110 may convert the first analog dimming signal $SA_1$ from the analog dimmer 20 into the first digital dimming signal $SD_1$, and the digital controller 120 may receive the first digital dimming signal $SD_1$ from the dimming signal conversion circuit 110, to allow the user to manually control brightness of the illumination device 50; and when the illumination power circuit 100 is connected with the computer 30 via the connecting port, the illumination power circuit 100 operates in the setting mode, the digital controller 120 may receive the control signal from the computer 30 to set one or more sets of parameters (e.g. one or more parameters within the program file) of the illumination power circuit 100, where the one or more sets of parameters correspond to one or more of an analog dimming function, an auto dimming function, a lifetime warning function, a light decay compensation function, a read status function, an update firmware function and an initial setting recovery function, respectively.

Figure 4:
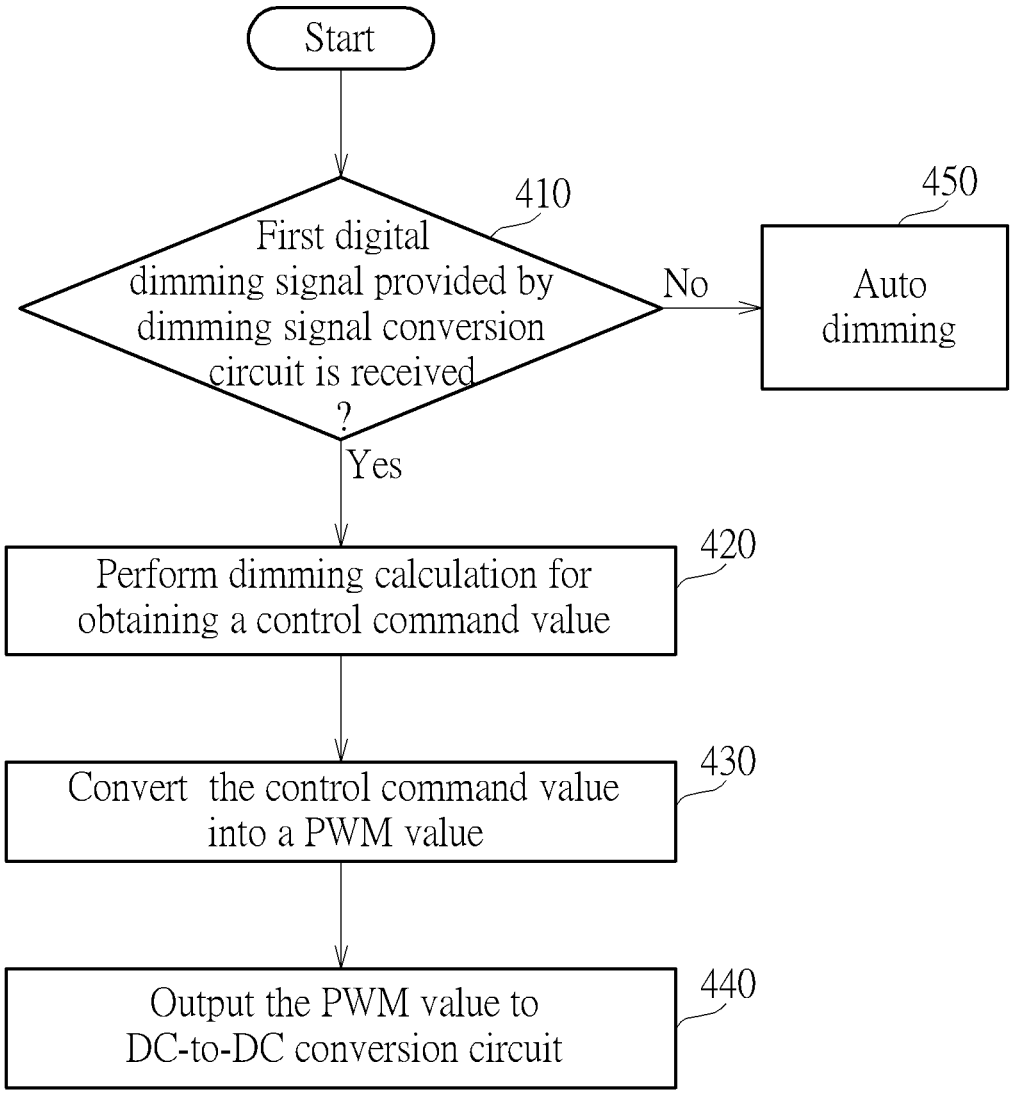
FIG. 4 is a related firmware command flow of a digital controller according to an embodiment of the present invention.

The present invention can utilize the digital controller 120 to perform auto dimming in an auto dimming mode by default, and can also allow the user to modify the brightness of the illumination device 50 by manually modifying the analog dimmer 20. For example, the digital controller 120 of the illumination power circuit 100 communicates with the computer 30 via UART communications, and the user can enable the analog dimming function (which may be referred to as a 1-10V dimming function) through a human-machine interface (or a user interface) of the computer 30, to thereby manually modify and control the analog dimmer 20 to output an analog dimming signal (e.g. the analog dimming signal $SA_1$) to the ADC circuit 111 within the dimming signal conversion circuit 110, where a related firmware command flow of the digital controller 120 is shown in FIG. 4.

In Step 410, the digital controller 120 may determine whether the first digital dimming signal $SD_1$ provided by the dimming signal conversion circuit 110 is received. If the determination result shows "Yes", the flow proceeds to Step 420; if the determination result shows "No", the flow proceeds to Step 450 and performs auto dimming.

In Step 420, when the digital controller 120 receives the first digital dimming signal $SD_1$ provided by the dimming signal conversion circuit 110, the digital controller 120 may utilize a dimming calculation conversion table, which is stored in advance in the digital controller 120, to perform dimming calculation for obtaining a control command value.

TABLE 1

| Voltage corresponding to control command value | Control command value |
|---|---|
| <232 mV | ≥9250 |
| 232 mV~3035 mV | 9250~750 |
| >3035 mV | ≤750 |

Table 1 shows an example of the dimming calculation conversion table, which is stored in advance therein, and is configured for performing the dimming calculation as mentioned above, but the present invention is not limited thereto.

In Step 430, the digital controller 120 may utilize a command-to-PWM conversion table stored therein to convert the control command value into a PWM value (e.g. a duty cycle of the PWM signal).

TABLE 2

| Control command value | PWM value |
|---|---|
| ≥9250 | Maximum = 100% |
| 9250~750 | 1%~100% (Linear) |
| ≤750 | Minimum = 1% |

Table 2 shows an example of the command-to-PWM conversion table, which is stored in advance therein, and is configured for converting the command value into the PWM value as mentioned above, but the present invention is not limited thereto.

In Step 440, the digital controller 120 may output a corresponding PWM value to a DC-to-DC conversion circuit such as the LED driving circuit 130 for performing digital dimming. Thus, the user needs to modify/control the analog dimmer 20 only, and advantages of PWM digital dimming can be obtained.

In addition, in the setting mode, the human-machine interface of the computer 30 may be configured to read status of the illumination device 50 and/or the illumination power circuit 100 and perform associated control. For example, the computer 30 may communicate with the illumination power circuit 100 via the UART interface. Related operations may include: obtaining power operating information, enabling auto dimming, enabling lifetime warning, enabling light decay compensation and enabling firmware update function. Furthermore, the user can utilize the human-machine interface for enabling/disabling the analog dimming function (e.g. 1-10V dimming function), reading status of the analog dimming function (e.g. 1-10V dimming function) and returning the setting to an initial value.

The aforementioned lifetime warning function may be designed according to a power lifetime or an LED lifetime, and a corresponding lifetime may be set according to power and specification of the LED. For example, the power lifetime function may determine a lifetime of a power according to a power operating time, where when the power operating time reaches the lifetime threshold, firmware of the digital controller 120 may issue a control signal to the LED of a lamp, making the lamp flicker, thereby reminding the user that the lamp needs to be repaired or replaced.

Figure 5:
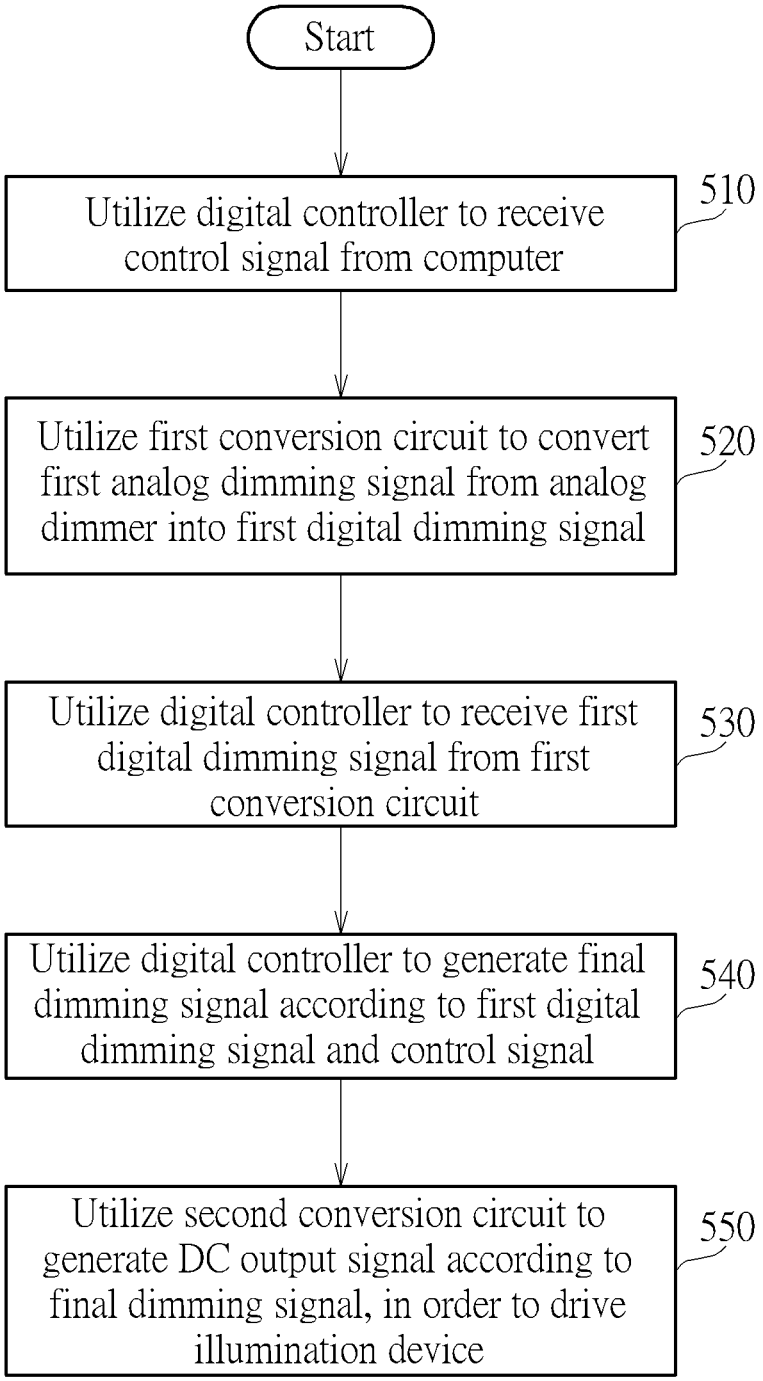
FIG. 5 is a diagram illustrating a working flow of a control method of an illumination power circuit according to an embodiment of the present invention.

FIG. 5 is a diagram illustrating a working flow of a control method of an illumination power circuit according to an embodiment of the present invention, wherein the illumination power circuit 100 shown in FIG. 1 may be an example of the illumination. It should be noted that the working flow shown in FIG. 5 is for illustrative purposes only, and is not meant to be a limitation of the present invention. One or more steps may be added, deleted or modified in the working flow. In addition, if a same result can be obtained, these steps do not have to be executed in the exact order shown in FIG. 5.

In Step 510, the illumination power circuit 100 may utilize the digital controller 120 to receive a control signal from the computer 30.

In Step 520, the illumination power device 100 may utilize a first conversion circuit such as the dimming signal conversion circuit 110 to convert the first analog dimming signal $SA_1$ from the analog dimmer 20 into a first digital dimming signal $SD_1$, where the analog dimmer 20 may be configured to generate the first analog dimming signal $SA_1$ according to operation of a user, to thereby allow the user to manually control brightness of the illumination device 50.

In Step 530, the illumination power circuit 100 may utilize the digital controller 120 to receive the first digital dimming signal $SD_1$ from the first conversion circuit such as the dimming signal conversion circuit 110.

In Step 540, the illumination power circuit 100 may utilize the digital controller 120 to generate at least one final dimming signal according to the first digital dimming signal $SD_1$ and the control signal.

In Step 550, the illumination power circuit 100 may utilize a second conversion circuit such as the LED driving circuit 130 to generate a DC output signal according to the at least one final dimming signal $S_{FINAL}$, in order to drive the illumination device 50.

To summarize, the illumination power circuit and the control method thereof provided by the embodiments of the present invention can convert an analog dimming signal from an analog dimmer into a digital dimming signal, to allow a digital controller (e.g. a MCU) to utilize firmware functions therein to process the digital dimming signal, and correspondingly control DC signals output from a LED driving circuit, in order to achieve the purpose of digital dimming.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An illumination power circuit with a dimming function, comprising:

a first conversion circuit, configured to convert a first analog dimming signal from an analog dimmer into a first digital dimming signal, wherein the analog dimmer is configured to generate the first analog dimming signal according to operations of a user, to allow the user to manually control brightness of an illumination device;

a digital controller, coupled to the first conversion circuit, configured to receive the first digital dimming signal and a control signal from a computer positioned at outside of the illumination power circuit, and generate at least one final dimming signal according to the first digital dimming signal and the control signal;

a second conversion circuit, coupled to the digital converter, configured to generate a direct current (DC) output signal according to the at least one final dimming signal, for driving the illumination device;

a rectifier circuit, configured to receive an alternating current (AC) voltage and convert the AC voltage into a first DC voltage;

a power factor correction (PFC) with pulse-width modulation (PWM) circuit, having an end coupled to the rectifier circuit, configured to perform power factor correction and pulse width modulation on the first DC voltage for outputting a second DC voltage, which is corrected and modulated, to the second conversion circuit; and a third conversion circuit, having an end coupled to the PFC with PWM circuit, having another end coupled to the digital controller, configured to convert the second DC voltage and output a third DC voltage to the digital controller.

2. The illumination power circuit of claim 1, wherein the first conversion circuit comprises:

an analog-to-digital conversion (ADC) circuit, configured to convert the first analog dimming signal into a digital dimming signal;

a protection circuit, coupled to an end of the ADC circuit, configured to protect the ADC circuit by limiting a current flowing to the ADC circuit; and an amplification circuit, coupled to another end of the ADC circuit, configured to amplify the digital dimming signal output from the ADC circuit, to generate the first digital dimming signal.

3. The illumination power circuit of claim 1, wherein the at least one final dimming signal is a second analog dimming signal or a second digital dimming signal; when the user controls the brightness of the illumination device to be lower than a predetermined brightness, the digital controller transmits the second digital dimming signal to the second conversion circuit to allow the second conversion circuit to generate the DC output signal according to the second digital dimming signal; and when the user controls the brightness of the illumination device to be higher than the predetermined brightness, the digital controller transmits the second analog dimming signal to the second conversion circuit to allow the second conversion circuit to generate the DC output signal according to the second analog dimming signal.

4. The illumination power circuit of claim 2, wherein the first conversion circuit further comprises a switch component or an optical coupler for transmitting the first digital dimming signal to the digital controller through isolated transmission.

5. The illumination power circuit of claim 1, wherein the first digital dimming signal is a pulse-width modulation (PWM) signal.

6. The illumination power circuit of claim 1, wherein each of the second conversion circuit and the third conversion circuit is a DC-to-DC conversion circuit.

7. The illumination power circuit of claim 1, wherein in a setting mode of the illumination power circuit, the digital controller receives the control signal from the computer, to set one or more sets of parameters of the illumination power circuit; and in a dimming mode of the illumination power circuit, the digital controller receives the first digital dimming signal from the first conversion circuit, to allow the user to manually control the brightness of the illumination device.

8. The illumination power circuit of claim 7, wherein the one or more sets of parameters respectively correspond to one or more of an analog dimming function, an auto dimming function, a lifetime warning function, a light decay compensation function, a read status function, an update firmware function and an initial setting recovery function.

9. A control method of an illumination power circuit, the illumination power circuit being equipped with a dimming function, the control method comprising:

utilizing a digital controller to receive a control signal from a computer positioned at outside of the illumination power circuit;

utilizing a first conversion circuit to convert a first analog dimming signal from an analog dimmer into a first digital dimming signal, wherein the analog dimmer is configured to generate the first analog dimming signal according to operations of a user, to allow the user to manually control brightness of an illumination device;

utilizing the digital controller to receive the first digital dimming signal from the first conversion circuit;

utilizing the digital controller to generate at least one final dimming signal according to the first digital dimming signal and the control signal;

utilizing a second conversion circuit to generate a direct current (DC) output signal according to the at least one final dimming signal, for driving the illumination device;

utilizing a rectifier circuit to receive an alternating current (AC) voltage and convert the AC voltage into a first DC voltage;

utilizing a power factor correction (PFC) with pulse-width modulation (PWM) circuit to perform power factor correction and pulse width modulation on the first DC voltage for outputting a second DC voltage, which is corrected and modulated, to the second conversion circuit; and utilizing a third conversion circuit to convert the second DC voltage and output a third DC voltage to the digital controller.

10. The control method of claim 9, wherein the step of utilizing the digital controller to receive the control signal from the computer is executed in a setting mode of the illumination power circuit, to set one or more sets of parameters of the illumination power circuit; and the step of utilizing the digital controller to receive the first digital dimming signal from the first conversion circuit is executed in a dimming mode of the illumination power circuit, to allow the user to manually control the brightness of the illumination device.

11. The control method of claim 9, wherein the one or more sets of parameters respectively correspond to one or more of an analog dimming function, an auto dimming function, a lifetime warning function, a light decay compensation function, a read status function, an update firmware function and an initial setting recovery function.

* * * * *